US005662364A

United States Patent [19]

Reeb et al.

[11] Patent Number: 5,662,364

[45] Date of Patent: Sep. 2, 1997

[54] LATCHING MECHANISM FOR CONTAINER LID

[76] Inventors: David L. Reeb, 3752 Esquire Dr., Canal Winchester, Ohio 43110; Walter Paul Robinette, II, 3551 Parsons Ave., Columbus, Ohio 43207

[21] Appl. No.: 492,729

[22] Filed: Jun. 20, 1995

[51] Int. Cl.[6] ..... E05C 3/12

[52] U.S. Cl. ..... 292/230; 292/DIG. 4

[58] Field of Search ..... 292/148, 230, 292/231, 232, 233, 234, 235, 236, 237, 238, 239, 252, DIG. 4; 220/315; 70/386

[56] References Cited

U.S. PATENT DOCUMENTS

| | | | |
|---|---|---|---|
| 2,535,947 | 12/1950 | Newell | 292/252 |
| 2,702,197 | 2/1955 | Sabatino | 292/252 |
| 4,086,794 | 5/1978 | Richards | 70/134 |
| 4,534,488 | 8/1985 | Baltz et al. . | |
| 4,865,368 | 9/1989 | McCall et al. | 292/175 |
| 5,029,724 | 7/1991 | Serio | 229/322 |
| 5,085,341 | 2/1992 | Hodge | 220/331 |
| 5,094,358 | 3/1992 | Serio, Jr. . | |
| 5,094,487 | 3/1992 | Drewry | 292/237 |
| 5,105,967 | 4/1992 | Horpestead | 220/333 |
| 5,201,434 | 4/1993 | DeVivo et al. | 220/315 |
| 5,415,314 | 5/1995 | McCollum | 220/315 |
| 5,474,341 | 12/1995 | Putman et al. | 292/230 |

*Primary Examiner*—Steven N. Meyers
*Assistant Examiner*—Donald J. Lecher
*Attorney, Agent, or Firm*—Longacre & White

[57] ABSTRACT

The invention is directed to a latch releasing mechanism for a container having a hinged or removable lid. A latching arm is disposed adjacent the container lid to prevent an opening of the lid, and a cable connects the latching arm to the locking mechanism. The elements of the latching mechanism comprise a slide plate to which the cable is fixed; a spring for urging the slide plate to a latched position, a guide member for guiding the slide plate, and a trigger ball which blocks movement of the slide am in the latched position. When the container is tilted forward by a predetermined angle, the trigger ball becomes dislodged from the latching position to enable movement of the slide plate, and subsequent movement of the latching arm. When the latching arm is moved out of the path of travel for the container lid, the contents of the container may be removed.

20 Claims, 7 Drawing Sheets

LATCHING MECHANISM FOR CONTAINER LID

FIELD OF THE INVENTION

The present invention relates to the field of latch releasing mechanisms for container lids. Specifically, the invention relates to an automatic pivoting latching mechanism for automatically latching and unlatching the access openings of dumpster containers.

BACKGROUND OF THE INVENTION

Many container lid latching mechanisms have been proposed. An example of a container lid latching system is disclosed in U.S. Pat. No. 4,534,488. While the many prior art container lid latching mechanisms have their uses, several shortcomings have become evident with respect to efficiently and effectively latching lids on large containers. Specifically, in the field of latching container lids for trash receptacles, there are few simple latching mechanisms, and even fewer retrofit mechanisms which can be applied to a broad variety of types and sizes of containers.

With the advent of mechanized trash removal, there have been created a number of large sized trash bins. These bins usually comprise a block shaped container with a hinged lid attached to one side thereof. The container further includes attachments for accommodating various forked lifting mechanisms of the trash removal vehicle. The containers are lifted by the lifting mechanism of the trash removal vehicle and pivoted in some fashion so that the hinged top of the container opens and the trash contained therein is emptied into the vehicle. The container is then returned to a position on the ground, and the hinged lid closes on top of the container.

Many of these large trash receptacles are rented from the trash removal service. These receptacles are not provided free of charge, and consequently their frequent emptying and service are sometimes a considerable expense. This expense is increased when unauthorized users of the receptacle freely deposit trash therein. This unauthorized use necessitates a more frequent emptying of the container, and of course the unauthorized user does not contribute to the increased expense.

For the foregoing reasons, there has existed a need to create a latching mechanism for these containers which is simple and reliable, and which can be retrofitted to a broad variety of containers. Historically, these containers have been formed of an all metal construction, and typically a fairly heavy gauge metal. However, many of the newer containers are of partial plastic construction or are of all plastic construction. Hence, the ability for a user or provider of the receptacle to attach a simple welded locking structure is limited owing to the fact that not all of the parts of the container can accommodate a weld.

Another problem of retrofitting existing containers or providing a broad application type of latching mechanism for variously sized containers is the question of custom sizing application. The solution to accommodating a broad size of containers is to create a latching mechanism which can be changed in dimension while not altering the basic operation of the latching mechanism.

Many containers currently in use have a latching bar extending above a hinged lid, whereby the latching bar is locked in place by a padlock. Trash removal services are required to approach the container, exit the vehicle to unlock the padlock, return to the vehicle to empty the container, exit the vehicle to relock the padlock, then move on to the next container. These container do not permit the automatic latching and unlatching of the container, and require more time to empty.

U.S. Pat. No. 5,094,358 provides a locking mechanism for a container having a hinged or removable lid. The locking mechanism is deactivated by tipping the container, for instance, during the dumping procedure. To achieve this purpose, the locking mechanism is provided with a pivotable swing lever or ball trigger which moves between an interference position whereby opening of the container lid is prevented, and a non-interference position whereby opening of the container lid is permitted.

However, the locking mechanism of U.S. Pat. No. 5,094,358 is fitted on to the front of the container, thus may interfere with the emptying procedure. Specifically, customer access to the container is substantially hampered by the cumbersome and poorly located locking mechanism and locking arm, which interfere with day-to-day customer use. Moreover, for containers having a locking bar originally fitted thereon, the owner must remove the locking bar then retrofit the container with the new locking mechanism and associated L-shaped locking bar. It is further noted that this locking mechanism is too heavy for many plastic containers.

The need therefore exists for a container latching mechanism which overcomes the aforementioned deficiencies in the prior art.

SUMMARY OF THE INVENTION

The present invention seeks to obviate the shortcoming of the prior art container lid latching mechanisms, while at the same time providing a solution to the need for a retrofit latching mechanism for a wide variety of container types, materials, and sizes. In addition, the present invention seeks to improve upon the locking mechanism disclosed in U.S. Pat. No. 5,094,358 by providing a latching mechanism which may be mounted to a container having a latching bar mounted to the container which extends across the hinged lid. Thus, the mechanism of the present invention may be retrofit onto existing containers with minimal modification to the container.

The present invention provides a latching mechanism which securely locks in place a removable or hinged container lid to a container, and which utilizes gravity to effect automatic disengagement of the same.

The container is provided with a latching bar which blocks the container lid from opening. The latching bar is mounted for rotation at the pivot point on the front side of the container. A cable or other connector connects the latching bar to the latching mechanism, whereby the latching mechanism releases the locking bar for rotation when the container is tipped forward by a predetermined angle.

The automatic pivoting latching mechanism of the present invention comprises a housing which is mounted to the side of the container. Fitted within the housing is a slide plate which reciprocates between latching and unlatching positions. A spring member acts on the slide plate to bias the slide plate toward the locking position.

Adjacent the slide plate is a fixed guide member which extends along the reciprocating direction of the slide plate. Both the slide plate and the guide plate are formed with an angled slot sized to receive a blocking member therein, typically formed as a ball trigger.

When the slide plate is in the latching position, the slot in the slide plate is aligned with the slot in the guide plate. In this position, the ball trigger is mutually received in both slots; the slot in the slide plate and the slot in the guide plate. When the ball trigger is in this locking position, the slide plate is prevented from reciprocational movement.

When the container to which the housing is fixed is tipped forward to an angle of approximately 45 degrees, the ball trigger is moved out of the slot in the guide plate by the force of gravity, and the slide plate is consequently permitted to slide into the unlocking position.

During this same forward tipping action, a tension is created on the cable due to the force of gravity acting on the locking bar. Connecting the latching bar to the latching mechanism is a cable which extends from the latching bar to the slide plate. When the container is tipped forward, the force of gravity moves the trigger ball out of the slot in the guide plate, and acts on the locking bar to cause a tension in the cable. The slide member is then permitted to reciprocate to the unlocked position, and the tension in the cable effects movement of the slide arm. As the slide plate moves to the unlocked position, the locking bar pivots to a forward position, thus freeing the container lid to open.

Both the container and lid can be made of a metal or plastic construction, or a combination of metal and plastic or some other light weight material.

In addition, the latching mechanism of the invention is not limited to front loading container, but may be fitted to side loading containers as well.

Customer access to the container is substantially improved by providing a locking bar which may be manually disconnected from the latching mechanism by a padlock. The locking bar may then be easily displaced to enable entry into the container with minimal effort.

The foregoing objectives of the invention will now be described with reference to the following drawings.

DETAILED DESCRIPTION OF THE PREFERRED EMBODIMENTS

Figure 1:
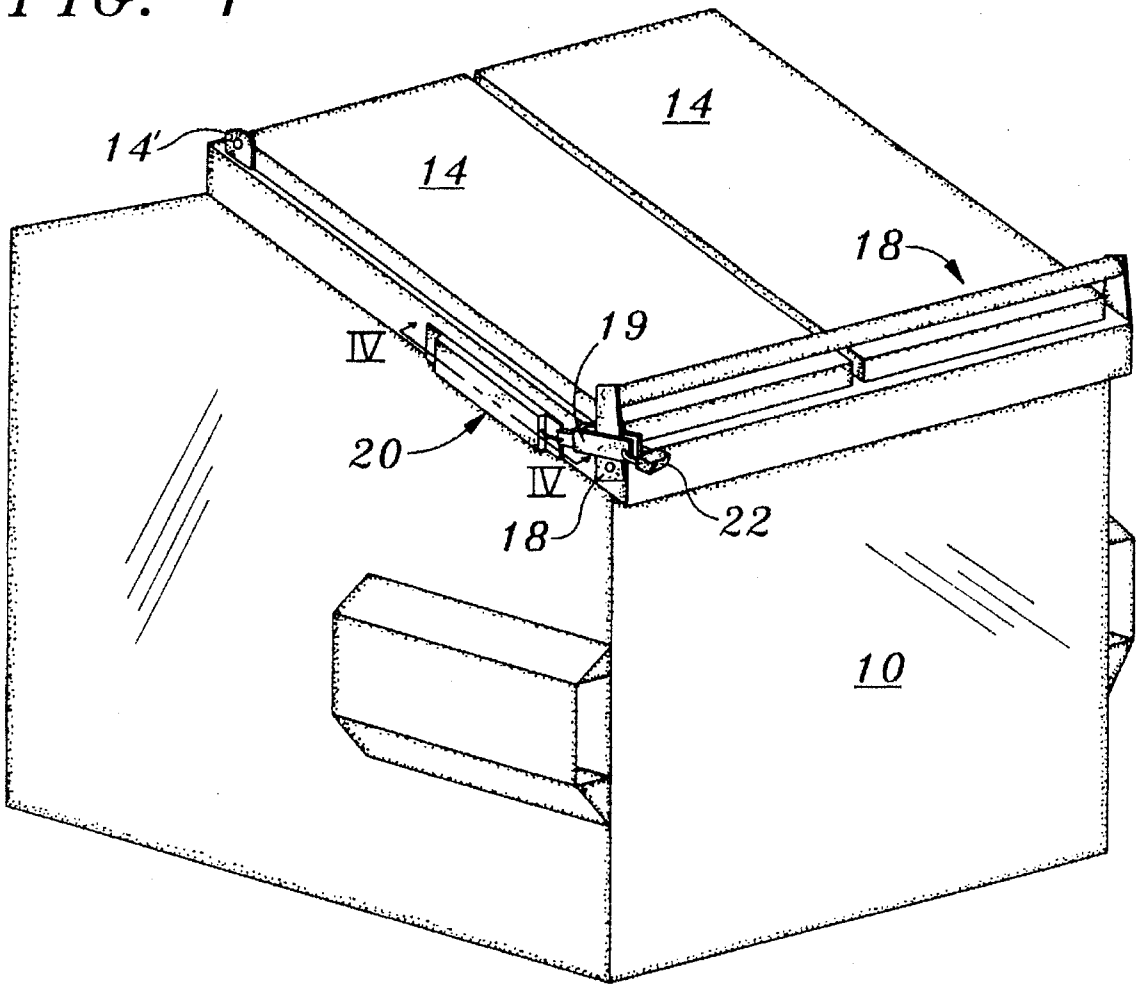
FIG. 1 is an isometric frontal view of a dumpster container and latching mechanism according to the present invention shown in the closed position.
Figure 2:
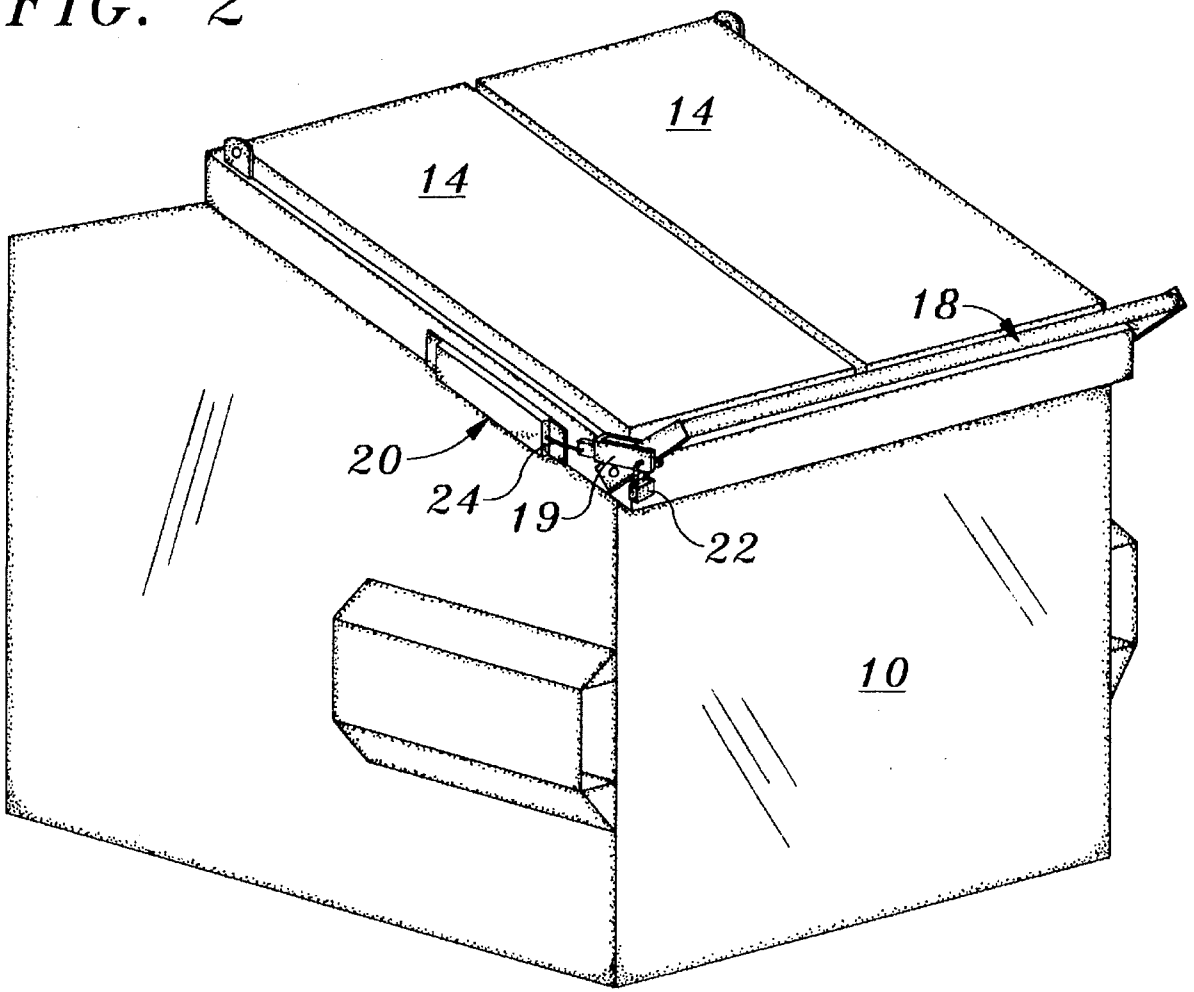
FIG. 2 is an isometric frontal view of the dumpster container of FIG. 1 shown in the open position with the latching bar pivoted forward of the container lid.

With reference to FIGS. 1 and 2, the present invention serves as a latching mechanism on a container 10 of the type illustrated or any container which is emptied by inversion. The container 10 of this type is provided with at least one pivoting lid 14 (two lids shown in FIG. 1 and 2), and a latching bar 18 which prevents the at least one pivoting lid 14 from opening. The lid 14 pivots about a pivot point 14' in order that the contents of the container 10 may be removed and properly disposed of, and the latching bar extends across the lid 14 to block this pivoting movement. The latching bar 18 is also pivotally supported on the container 10 at a pivot point 18' in order that the bar 18 may be moved out of path of the lid 14 in order that the lid 14 may be opened, and that the contents of the container 10 may be removed.

Figure 3:
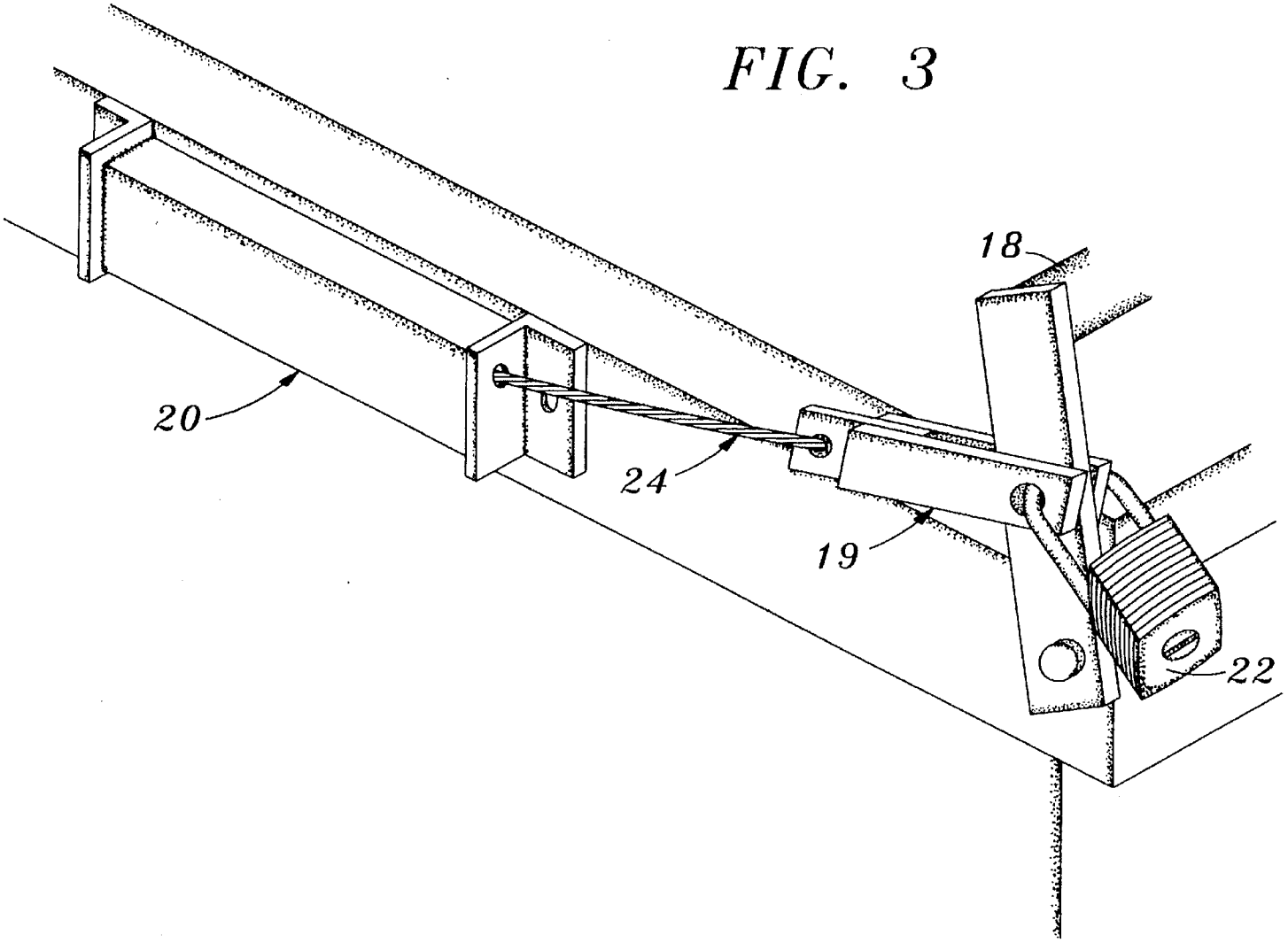
FIG. 3 is an enlarged isometric frontal view of the latching mechanism of FIG. 1 shown in the closed position with the latching bar blocking movement of the container lid.

The latching mechanism of the invention is positioned on the container 10 within the housing 20. Affixed to the locking bar 18 is a cable 24 which extends from within the housing 20 to the connecter 19. The connector 19 removably affixes the cable 24 to the latching bar 18. A padlock 22 may be used to detach the cable 24 from the locking bar 18 to enable manual movement of the bar 18 (see FIGS. 2 and 3). With this arrangement, customer access is substantially simplified to enable easy entry into the container by any authorized user. The housing 20 may be welded to a metal container or may be bolted to the container in a suitable manner.

Figure 4:
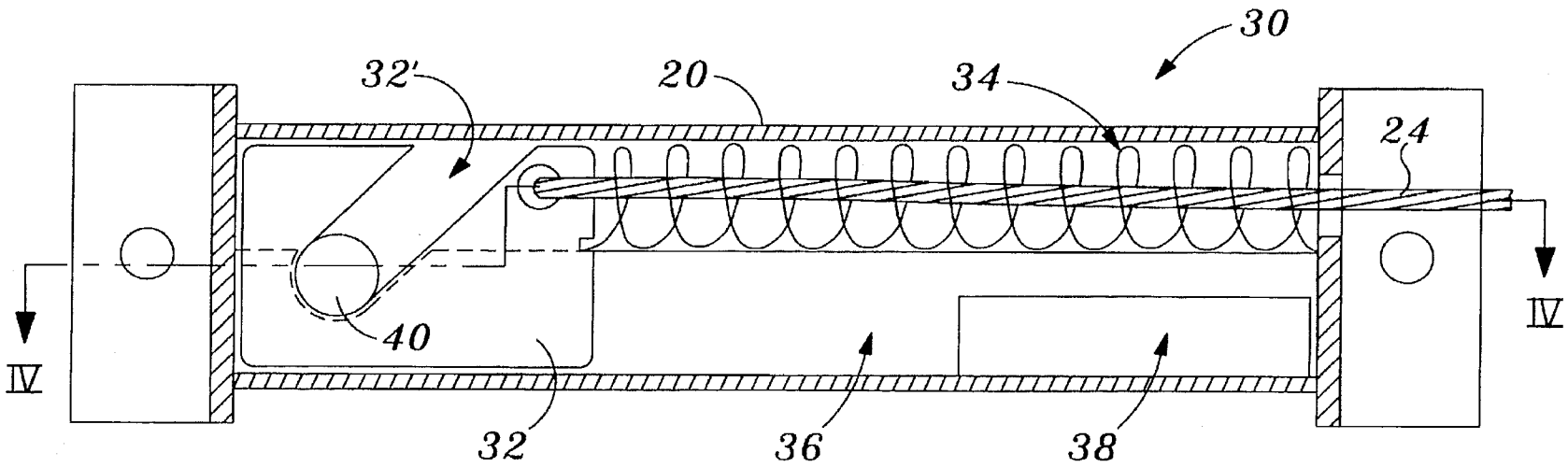
FIG. 4 is a cross-sectional view of the latching mechanism taken along line IV—IV in FIG. 1 showing the latching mechanism in the locking position.
Figure 5:
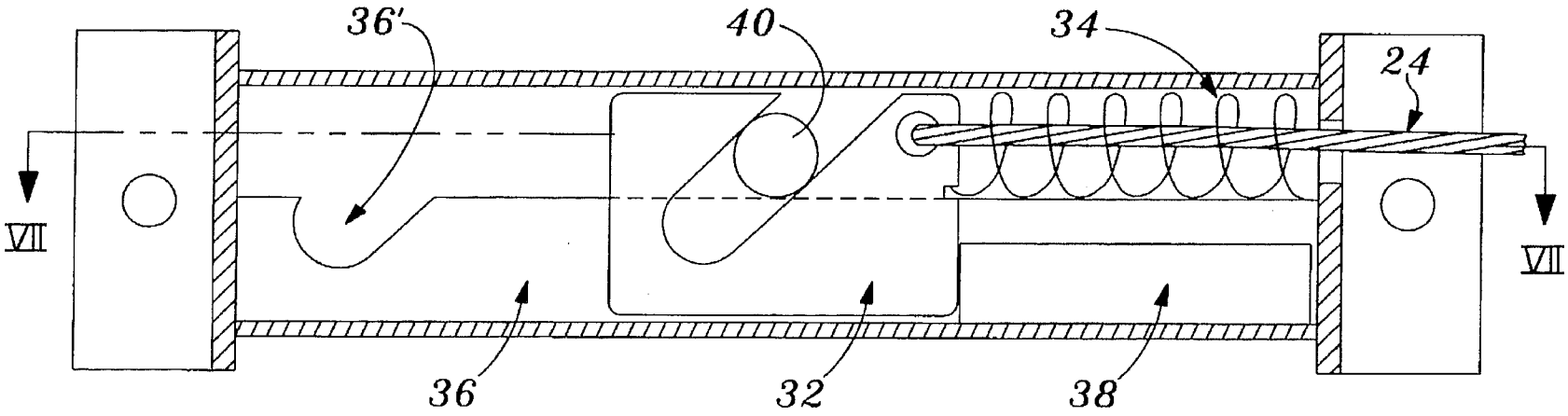
FIG. 5 is the cross-sectional view of FIG. 4 with the latching mechanism in the unlocked position.

Referring more specifically to the working parts of the latching mechanism, FIG. 4 shows an automatic latching mechanism 30 for the dumpster container 10. The automatic latching mechanism 30 comprises a slide plate 32 to which the cable 24 is fixed; a spring 34, a guide member 36, a bumper member 38, and a trigger ball 40. The spring 34 biases the slide plate 32 in the leftward direction as shown in FIG. 4. The guide member 36 guides the slide plate 32 for translational movement between a latched position (FIG. 4) and an unlatched position (FIG. 5). The bumper member 38 cushions the movement of the slide plate 32 in the unlocked position (see FIG. 5), and stops the slide plate 32 in the rightward position. In addition, the bumper 38 preserves the spring 34 and other working parts of the latching mechanism 30.

The trigger ball 40 is fitted within a slot 32' provided in the slide plate 32, and is carried by the slide plate 32 during its translational movement. A corresponding slot 36' (see FIG. 5) is provided in the guide plate 36 in such a manner that when the slide plate 32 is in its leftmost position (FIG. 4), the trigger ball 40 becomes trapped in both slots 32' and 36' to fix the slide plate 32 in the locked position, thus preventing the slide plate 32 from moving in response to tension on the cable 24.

As shown in FIG. 4, the slot 32', the guide member 36 and housing 20 define a retention chamber in which the trigger ball is maintained during movement of the slide plate 32 between the latched and unlatched positions.

When the container 10 is in a substantially level position, the spring 34 resiliently biases a slide plate 32 toward the latched position which is the leftmost position shown in FIG. 4. When the slide plate 32 reaches this leftmost position, the trigger ball 40 is trapped in both slots 32' and 36', and the latching mechanism 30 is placed in the latched position.

If the container 10 is tilted forward, for instance, during a dumping procedure, the latching mechanism is likewise tilted forward. When the latching mechanism 30 is tilted forward to a predetermined angle defined by the annular disposition of the slots 32' and 36' (preferably about 45 degrees), the trigger ball 40 is dislodged from the slot 36' by the force of gravity as shown in FIG. 5. Once the trigger ball 40 is dislodged from the slot 36', the slide plate 32 is free to move in response to a tension on the cable 24.

When the container 10 is tilted forward in this manner, gravity also acts on the latching bar 18 to create a tension on the cable 24. This tension causes the slide plate 32 to move in the rightward direction as shown in FIG. 5. As a result, the locking bar 18 pivots out of the path of the lid 14 as shown in FIG. 2. If the container 10 is further inverted, the lid 14 will open and the contents of the container 10 will be discharged.

Significantly, the present invention not only provides a useful automatic latching device, but further provides a mechanism which serves to automatically latch the lid 14 to prevent unauthorized opening of the container 10. It is noted that the spring 34 is designed and selected to provide a resiliency which may only slightly overcome the weight of the locking bar 18. Thus, the slide plate 32 may remain in rightward position shown in FIG. 5 until the container is slightly jolted by a contact force caused when the container contacts the ground following the emptying procedure. This balance between the weight of the latching bar 18 and the force of the spring 34 ensures that the latching bar will not return to the closed position before the lid 14.

When the container 10 is returned to a substantially level position (and the container is jolted by contact with the ground), the spring 34 once again acts to return the slide plate 32 to the locked position of FIG. 4 where the trigger ball 40 is returned to the slot 36'.

Figure 6:
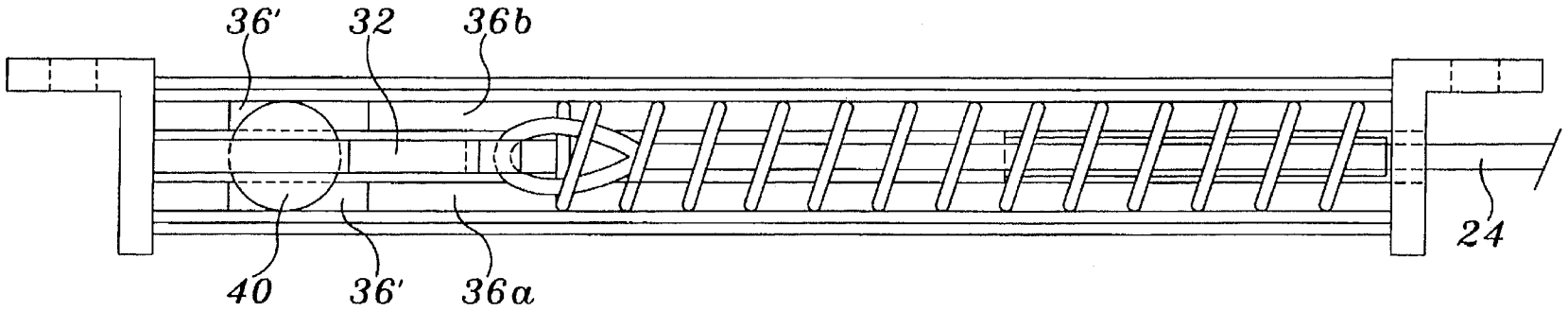
FIG. 6 is a cross-sectional top view of the latching mechanism taken along line VI—VI of FIG. 4 showing the latching mechanism in the locked position.
Figure 7:
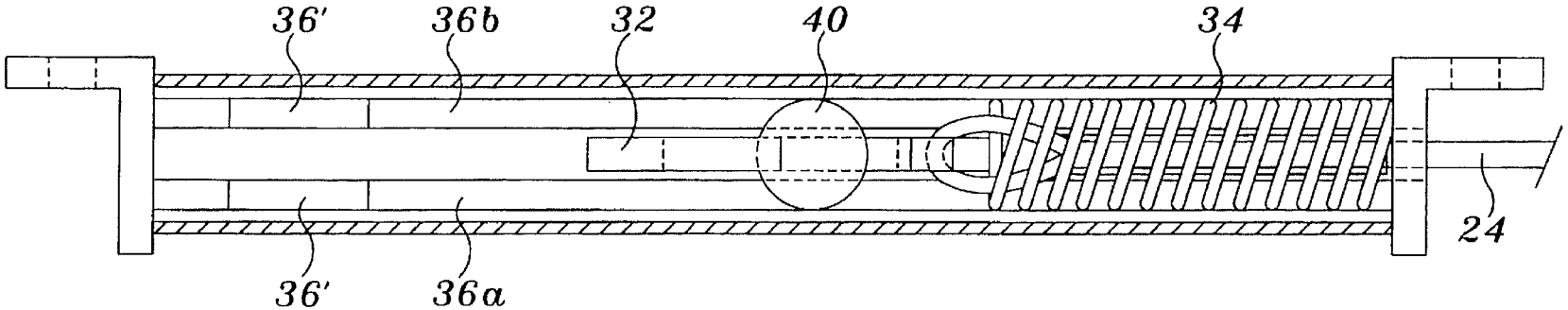
FIG. 7 is a cross-sectional top view of the latching mechanism taken along line VII—VII of FIG. 5 showing the latching mechanism in the unlatched position.
Figure 8:
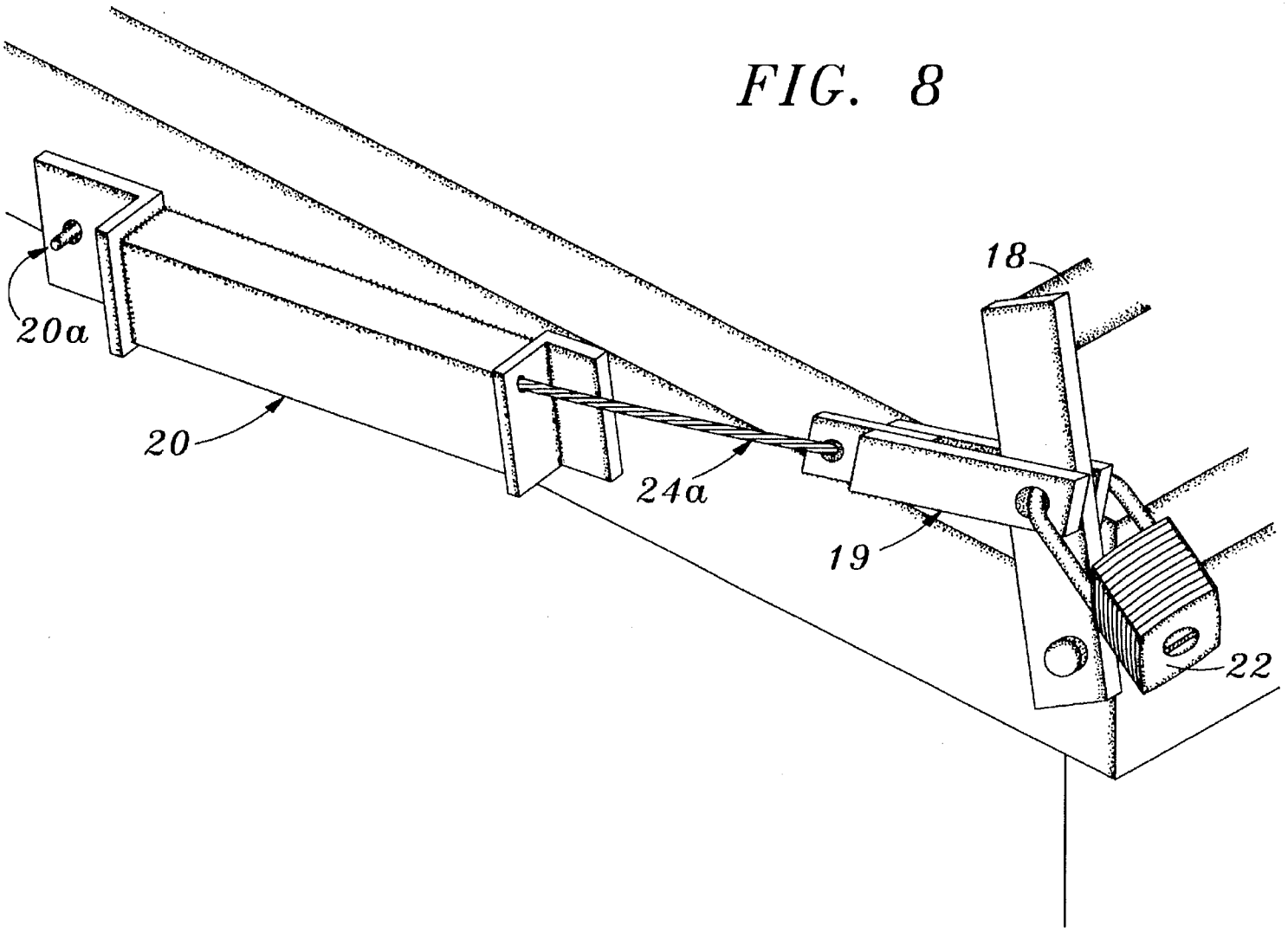
FIG. 8 is an enlarged isometric frontal view of the latching mechanism showing an alternate embodiment wherein the cable 24 is replaced with a rigid rod 24*a* and the housing 20 is pivotally mounted to the container 10 at pivot point 20*a*.

FIGS. 6 and 7 provide a top cross-sectional view of the preferred design of the latching mechanism of the present invention. As clearly illustrated by these drawings, the slide plate 32 is retained between two parallel wails 36*a*, 36*b* of the guide member 36. Each of the parallel walls 36*a*, 36*b* is provided with a slot 36' for retaining the trigger ball 40 in the latched position. FIG. 6 illustrates the locking mechanism in the latched position whereby the trigger ball 40 is positioned within both slots 36' and transverses the slide plate 32 through the slot 32'. FIG. 7 illustrates the latching mechanism in the unlocked position whereby the trigger ball 40 is dislodged from the slots 36', and the slide plate 32 is moved in the rightward direction to compress the spring 34. In this position, the trigger ball 40 is carried by the slide plate 32.

As shown in FIGS. 1 and 2, a second lid 14 may be attached to the dumpster container 10, allowing the latching bar 18 to extend securely across the front of the dumpster container 10 and to block movement of both lids 14. Both the dumpster container 10 and its lid(s) 14 may be made out of all metal, or another suitable nonmetal material, such as plastic or other light-weight material.

In an alternate embodiment, the slide plate 32 may be connected to the latching bar through a rigid rod 24*a* which is suitably fastened to the latching bar 18 and slide plate 32 respectively. In this instance, the housing 20 for the latching mechanism 30 may be secured to the container at a single pivot point 20*a* in order to compensate for the lost flexibility previously provided by the cable 24.

Further variations of the present invention will occur to those skilled in the art, and the embodiments described above are not in any way intended to limit the scope of this invention.

What is claimed is:

1. An automatic pivoting latching mechanism for a container having a hinged lid, said latching mechanism comprising:

a latching arm adapted to be mounted for movement with respect to said lid between an open position and a closed position, said latching arm adapted to interfere with a movement of said hinged lid in said closed position;

a slide member connected to said latching arm and adapted to be slidingly disposed for movement with respect to said container from a latched position related to said closed position to an unlatched position related to said open position;

a guide member adjacent said slide member and adapted to be fixed with respect to said container; and a trigger means for automatically latching said slide member to said guide member when said container is in a substantially level position, said trigger means being moved from a latching location to an unlatching location by gravitational force when said container is tilted to a predetermined angle.

2. The automatic pivoting latching mechanism according to claim 1, wherein said trigger means is retained within a first slot provided on said slide member as said slide member moves with respect to said container.

3. The automatic pivoting latching mechanism according to claim 2, wherein said first slot extends at an angle with respect to a horizontal direction.

4. The automatic pivoting latching mechanism according to claim 3, wherein said angle is between 30 and 60 degrees.

5. The automatic pivoting latching mechanism according to claim 3, wherein said angle is substantially equal to 45 degrees.

6. The automatic pivoting latching mechanism according to claim 2, wherein said guide member comprises a second slot substantially in register with said first slot when said slide member is in said latched position.

7. The automatic pivoting latching mechanism according to claim 6, wherein said trigger means is at least partially located within both said first slot and said second slot in said latching location to retain said slide member in said latched position.

8. The automatic pivoting latching mechanism according to claim 1, wherein said trigger member is fixed with respect to said guide member in said latching location.

9. The automatic pivoting latching mechanism according to claim 1, wherein said trigger means comprises a blocking member carried by said slide member along a substantially level plane from said latched position to said unlatched position.

10. The automatic pivoting latching mechanism according to claim 1, further comprising a resilient member biasing said slide member toward said latched position.

11. The automatic pivoting latching mechanism according to claim 1, further comprising a bumper member forming a stop to cushion said slide plate during movement toward said unlatched position.

12. The automatic pivoting latching mechanism according to claim 1, wherein said slide member is connected to said latching arm through a flexible cable.

13. The automatic pivoting latching mechanism according to claim 1, wherein said slide member is connected to said latching arm through a rigid member.

14. The automatic pivoting latching mechanism according to claim 1, wherein said latching mechanism further comprises: a means for pivotably mounting said slide member, said guide member, and said trigger means on said container.

15. An automatic pivoting latching mechanism for a container having a hinged lid, said latching mechanism comprising:

a latching arm adapted to be pivotally mounted with respect to said lid between an open position and a closed position, said latching arm adapted to interfere with a movement of said hinged lid in said closed position;

a slide member connected to said latching arm adapted to be and slidingly disposed on said container for movement along a substantially level plane, said slide member comprising a retaining slot disposed at an angle with respect to said level plane;

a fixed guide member adjacent said slide member, and comprising a fixed slot disposed at said angle of said retaining slot; and a trigger means for automatically latching said slide member to said guide member when said container is in a substantially level position, said trigger means being moved within said retaining slot from a latching position to an unlatching position by gravitational force when said container is tilted to a predetermined angle, wherein said trigger means at least partially disposed in both said retaining slot and said fixed slot in said latching position.

16. The automatic pivoting latching mechanism according to claim 15, wherein said trigger means comprises a blocking member carried by said slide member along said substantially level plane from said closed position to said open position.

17. The automatic pivoting latching mechanism according to claim 15, wherein said retaining slot is in register with said fixed slot when said latching arm is in said closed position.

18. The automatic pivoting latching mechanism according to claim 15, further comprising a spring means for urging said latching arm toward said closed position.

19. The automatic pivoting latching mechanism according to claim 15, wherein said triggering means positively latches said slide member to said guide member to prevent linear translation of said slide member with respect to said guide member in either a forward or reverse direction.

20. The automatic pivoting latching mechanism according to claim 19, wherein said triggering means is vertically displaced with respect to said substantially level plane when said triggering means is moved from said latching position to said unlatching position.

* * * * *